US006845579B2

(12) United States Patent
Weiser

(10) Patent No.: US 6,845,579 B2
(45) Date of Patent: Jan. 25, 2005

(54) SUPPORTED NOVELTY WITH BALLAST

(75) Inventor: Margaret Weiser, Tarzana, CA (US)

(73) Assignee: Exhart Environmental Systems, Inc., Chatsworth, CA (US)

( * ) Notice: Subject to any disclaimer, the term of this patent is extended or adjusted under 35 U.S.C. 154(b) by 0 days.

(21) Appl. No.: 10/452,249

(22) Filed: May 30, 2003

(65) Prior Publication Data

US 2004/0237363 A1 Dec. 2, 2004

(51) Int. Cl.[7] ..... A47F 11/06
(52) U.S. Cl. ..... 40/427; 446/30
(58) Field of Search ..... 40/411, 414, 417, 40/427, 429, 430, 431, 455; 446/30, 35, 61, 62, 73, 236; 119/706, 707; 428/708, 16

(56) References Cited

U.S. PATENT DOCUMENTS

| | | | | | |
|---|---|---|---|---|---|
| 278,461 | A | | 5/1883 | Screven | 446/376 |
| 355,578 | A | | 1/1887 | Wetzell | 446/352 |
| 1,727,700 | A | | 9/1929 | Dickson | 446/387 |
| 2,026,934 | A | | 1/1936 | DeRosa | 63/20 |
| 2,028,593 | A | | 1/1936 | DeRosa | 63/20 |
| 2,061,189 | A | | 11/1936 | Dungan | 73/170.07 |
| 2,528,268 | A | | 10/1950 | Dickinson | 446/30 |
| 2,725,654 | A | * | 12/1955 | Kosikar | 428/16 |
| 3,040,476 | A | | 6/1962 | Green | 446/190 |
| 3,402,929 | A | * | 9/1968 | Glass et al. | 446/325 |
| D244,767 | S | | 6/1977 | Ditto | D11/137 |
| 4,131,079 | A | * | 12/1978 | Rousseau et al. | 428/16 |
| 4,180,932 | A | * | 1/1980 | Millard | 40/455 |
| D303,685 | S | | 9/1989 | Vafiadis | D21/59 |
| 4,930,448 | A | * | 6/1990 | Robinson | 119/708 |
| 4,949,486 | A | | 8/1990 | Belokin et al. | 40/414 |
| D317,030 | S | | 5/1991 | Peyton | D21/185 |
| 5,146,702 | A | * | 9/1992 | Belokin, Jr. | 40/430 |
| 5,148,769 | A | * | 9/1992 | Zelinger | 119/708 |
| 5,322,036 | A | * | 6/1994 | Merino | 119/707 |
| 5,524,851 | A | * | 6/1996 | Huang | 446/61 |
| D394,463 | S | | 5/1998 | Filho | D21/93 |
| 5,823,844 | A | * | 10/1998 | Markowitz | 40/414 |
| D402,231 | S | | 12/1998 | Mumford | D11/162 |
| 5,924,387 | A | * | 7/1999 | Schramer | 119/708 |
| 6,038,812 | A | * | 3/2000 | Belokin et al. | 40/414 |
| D464,685 | S | * | 10/2002 | Weiser et al. | D21/650 |
| 6,572,428 | B1 | * | 6/2003 | Weiser et al. | 446/35 |
| 6,599,160 | B2 | * | 7/2003 | Weiser et al. | 446/35 |

* cited by examiner

*Primary Examiner*—Lars A. Olson
(74) *Attorney, Agent, or Firm*—Cislo & Thomas LLP

(57) ABSTRACT

A novelty system of the present invention includes a novelty portion, ballast and a post portion; the post portion configured to support the novelty portion and ballast such that the post portion flexes.

22 Claims, 2 Drawing Sheets

SUPPORTED NOVELTY WITH BALLAST

BACKGROUND OF THE INVENTION

1. Field of the Invention

This invention relates generally to novelty items such as toys or novelties of the type that may move in response to a small amount of force acting upon it, and specifically to novelties that move or appear to be flying, hovering or fluttering about.

2. Background of the Invention

Articulated toy figures and simulated novelty items that move are well known in the art and have been used in a variety of functions and appearances. Such figures and novelty items are generally fairly complex and require some mechanism which moves the novelty item in a continual fashion or intermittently by means of an electrical or mechanical force acting upon the toy.

The ubiquitous flying duck having a pair of wings mounted on an axle is one commonly found novelty in gardens or the like, and there are of course more sophisticated novelty items employing a wide variety of mechanisms in order to impart some type of movement to the novelty to make the novelty more interesting to watch or observe.

SUMMARY OF THE INVENTION

In one embodiment, a novelty system of the present invention includes a novelty portion and a flexible post portion that supports the novelty portion such that the flexible post portion flexes. This may simulate the natural movement of the novelty portion, when acted upon by relatively small forces.

A ballast portion is included to add weight and stability to the system. Furthermore, a base may also be included in the system to support the flexible post portion. More than one ballast element may be included in the ballast portion, and more than one ballast portion may be included in the system. The flexible post portion may include one or more termini for securement purposes.

These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently-preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention as set forth in the independent claims.

For example, while the drawings show winged simulated creatures such as birds and insects, the invention can also be extended to novelty items such as skeletons utilized at Halloween, or other embodiments wherein the novelty items are suspended and slight forces on the system will cause movement. Furthermore, the appendages or extensions such as limbs or the like are configured such that slight vibrational movements or movement of the novelty item itself causes the appendages or extended limbs to move in an undulating or up and down fashion.

The invention is illustrated herein with respect to simulated winged creatures wherein the wings may be movable in a more realistic up and down fashion for the purpose of illustrating the invention sufficiently to enable any person skilled in the art to which it pertains to make or use the same.

Figure 1:
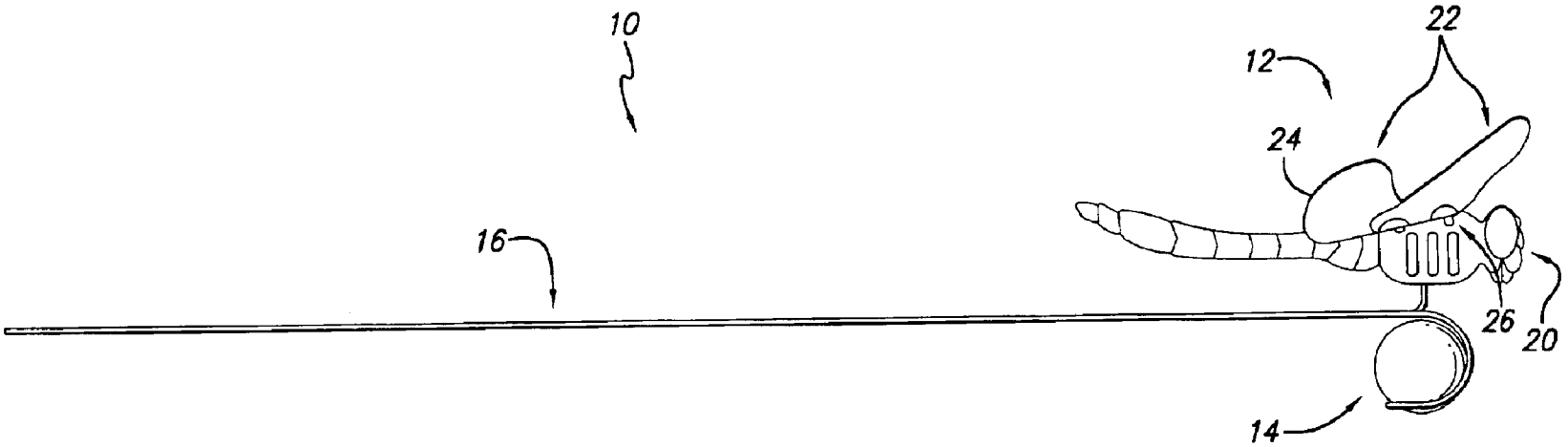
FIG. 1 is a perspective view of one embodiment of the present invention, depicting a dragonfly.

A novelty system according to one embodiment of the present invention is shown in FIG. 1, generally at 10. System 10 typically includes a novelty portion 12, a ballast portion 14, and a post portion 16 which is configured to support novelty and ballast portions 12 and 14. The post portion 16 is integrally formed ideally flexible and is coupled to novelty portion 12 and ballast portion 14 such that post portion 16 flexes at varying amounts when acted upon by relatively small forces, such as a breeze or vibrating forces. When this occurs, it may seem as though novelty portion 12 is suspended in air, or fluttering about. Furthermore, when post portion 16 flexes in varying amounts, this may simulate the movement novelty portion 12 would exhibit in nature. Novelty system 10 is configured to be placed in a flowerpot and soil, or connected to another type of base element, and to extend above the base element simulating an insect or bird hovering or fluttering above an object or surface.

Novelty portion 12 typically includes a body member 20 and at least one extension member 22. Each extension member 22 typically includes a wing element 24, and an attachment element 26, which is configured to couple wing element 24 and body member 20. Attachment element 26 is typically configured to flex and allow relatively free movement of wing element 24 with relatively small amounts of force acting upon it.

Wing element 24 is typically configured to look like an insect or bird wing, but also may be another type of element, such as an appendage of a Halloween character, or the like. Extension member 22 will typically move in a manner simulating the movement of an insect or bird wing in nature, when acted upon by relatively small amounts of force. Therefore, a relatively small force that may cause post portion 16 to vary its amount of flex, may cause novelty portion 12 to simulate hovering or fluttering, and may also cause extension members 22 to simulate wing movement.

Attachment element 26 is typically a coil spring but may be another element that allows wing element 24 to move with small amounts of force acting upon it. Although two attachment elements 26 per wing element 24 are shown, it will be appreciated that one or more attachment elements 26 may be used, as desired. Attachment element 26 is typically 0.0625–2.0 inches in length and 0.015–0.25 inches in diameter, however other dimensions may be utilized, as desired. Wing element 24 is typically plastic or colorfully painted plastic or ceramic, however, other materials may be used for the novelty portion, as desired. Wing element 24 is typically 3–5 inches in length and in height, but may be larger or smaller as desired.

Novelty portion 12 may be selectively positional with respect to post portion 16 such that it may be positioned facing any direction. Although a dragonfly is shown in FIG. 1, it will be appreciated that many other insects, birds or other figures may be used for novelty portion 12, including Halloween or other figures with moving appendages.

In this embodiment, integrally formed post portion 16 is dependingly configured to partially encircle ballast portion 14 to support it in a releasable fashion. It will be appreciated that other configurations for post portion 16 may be used to support ballast portion 14. Furthermore, post portion 16 is shown in a non-flexed state, however, desirably it flexes in varying degrees depending on the characteristics of the system.

Figure 2:
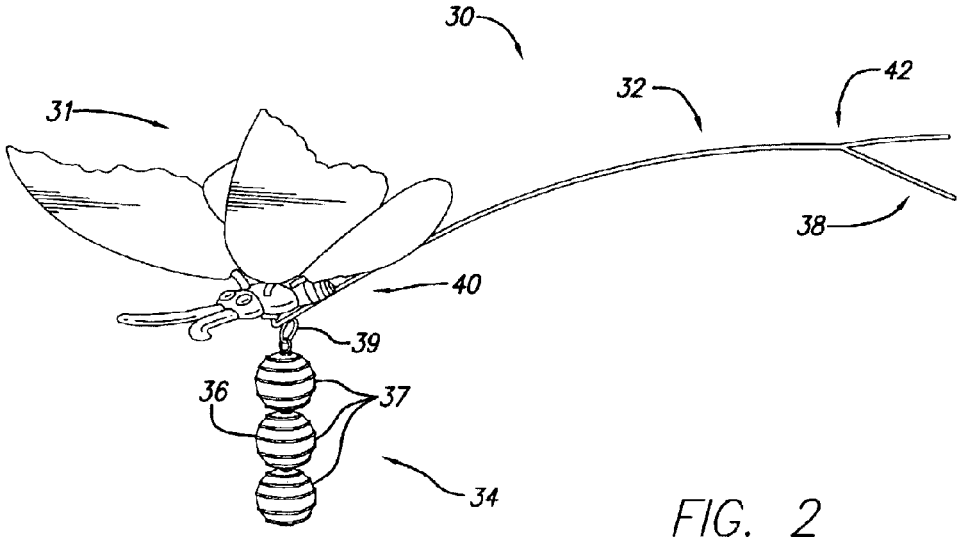
FIG. 2 is a perspective view of another embodiment of the present invention, shown in a flexed position, depicting a butterfly.
Figure 3:
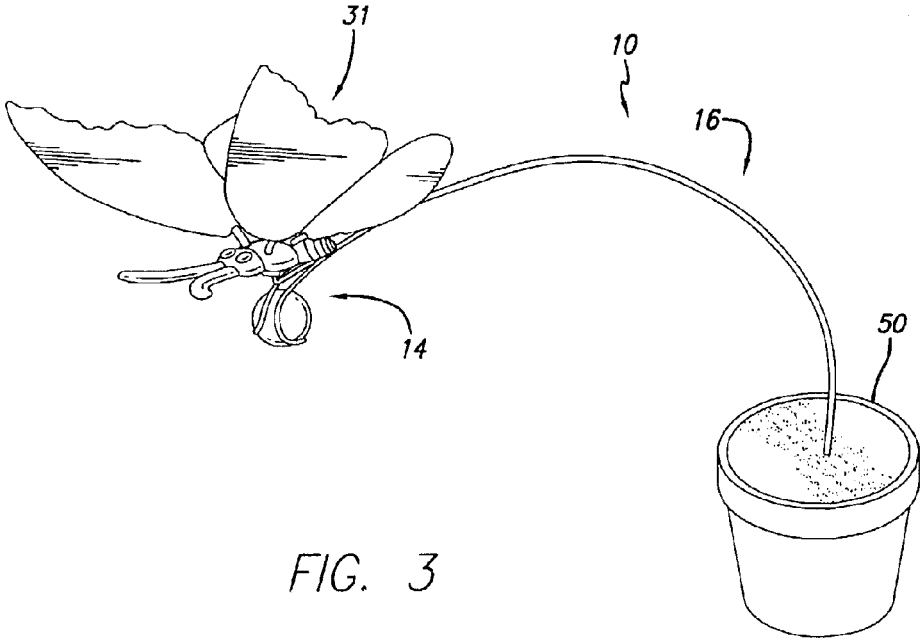
FIG. 3 is a perspective view of yet another embodiment of the present invention extending into a flowerpot.

Ballast portion 14 is typically a translucent, colored glass sphere as shown in FIGS. 1–3, being about 0.5–2.0 inches in diameter and weighing about 0.3–1.0 ounces, however, it will be appreciated that ballast portion 14 may be of any shape, size, color or weight that will cause post portion 16 to flex with relatively small forces acting upon it, to simulate natural movement. It will also be noted that although one ballast portion is shown, any number of ballast portions may be utilized, in many different configurations, to create the desired effect and/or desired aesthetic appearance.

Novelty portion 12 is typically plastic or colorfully painted plastic, however, other materials, such as ceramic, may be used for the novelty portion 12, as desired. Novelty portion 12 is typically 3–5 inches in length, and in height, but may be larger or smaller as desired.

Post portion 16 is typically a thin metallic rod or wire, may be of various colors and materials, including plastic that will allow it to flex in varying amounts. Post portion 16 is typically 12.0–24.0 inches in length and 0.015–0.125 inches in diameter, however, other dimensions for post portion 16 may be utilized, as desired.

In this exemplary embodiment, post portion 16 is approximately 15.5 inches in length, wing members 22 are approximately 1.5 by 2.5 inches, novelty portion 12 is approximately 4 by 0.4 by 0.6 inches, and ballast portion 14 is 0.875 inches in diameter.

FIG. 2 depicts another embodiment of the present invention, generally at 30. Novelty system 30 includes a butterfly novelty portion 31, a post portion 32 and a ballast portion 34. In this embodiment, novelty system 30 further includes a ballast-support portion 36, which is configured to couple to, and may support, ballast portion 34.

In this embodiment, post portion 32 includes a first end 40 coupled to ballast support portion 36, and a second end 42 configured with one or more termini or leg members 38. Leg members 38 are configured to couple to a base element, such as soil in a flowerpot, to secure the position of post portion 32. Leg members 38 are typically 1.0–6.0 inch es in length, but other dimensions may be utilized, as desired.

FIG. 2 depicts the novelty system with post portion 32 shown in a flexed position. It will be appreciated that post port ion 32 may have varying a mounts of flex.

Furthermore, the embodiment in FIG. 2 is shown with two leg members 38, however, different numbers of leg members may be utilized, as desired.

Ballast support portion 36 is configured to couple to, and may support, ballast portion 34. Ballast portion 34 may include one or more ballast elements 37. Ballast support portion 36 is typically a single, flexible, coiled wire configured in a cage-like manner to enclose ballast elements 37, in a flexible releasable configuration, however, other configurations may be used to support ballast elements 37, including a support extending through the ballast elements. Ballast elements 37 are typically 0.25–1.0 inch in diameter, and weigh 0.3–1.0 ounce, translucent, glass, colored spheres, it will be appreciated that many different sizes, colors, shapes, weights and materials could be used as ballast elements 37.

Ballast support portion 36 is typically coupled to post portion 32 via the flexible, coiled wire design connecting to post portion 32, however, it will be appreciated that many other configurations could be utilized. Ballast support portion 36 typically extends away from post portion 32 0.75–6.0 inches, however, other dimensions may be utilized, as desired.

In this embodiment, post portion 32 is configured with a connection portion 39 that is coupled to ballast support portion 36. Connection portion 39 is a loop configuration, however, other configurations may be utilized, as desired. Ballast support portion 36 typically has a hook-like configuration to couple to connection portion 39 of flexible post portion 32. With this configuration, ballast support portion 36 may be removable such that any number may be connected to post portion 32, including none. Furthermore, in this embodiment butterfly novelty portion 31 is shown as a butterfly, however, it will again be appreciated that other novelty items or figures may be used, as desired.

In this exemplary embodiment, post portion 32 is approximately 17.0 inches in length, wing members 22 are approximately 3.0 by 5.5 inches, novelty portion 12 is approximately 4 by 0.4 by 0.6 inches, ballast elements 37 are 0.875 inches in diameter, and ballast portion 14 extends away from post portion 32 approximately 3.0 inches.

FIG. 3 shows a novelty system of the present invention similar to that depicted in FIG. 1 except a butterfly rather than a dragonfly is used as the novelty with post portion 16 in a flexed position, generally at 10. In this embodiment, flexible post portion 16 is coupled to a base 50. Base 50 is typically a flowerpot and soil or block weight, but may be another type of apparatus or configuration that couples to flexible post portion 16 to support the system. Novelty system 10 is configured such that a small amount of force such as a light summer breeze or slight vibration will cause post portion 16 to flex, which may cause novelty portion 12 to flutter and move about, simulating the movement of a bird or insect in nature. Base 50 is configured to couple to to, and support, post portion 16.

Ballast portion 14 is configured such that post port ion 16 will flex more or less depending on small amounts of force being exerted on it. The small amount of force may be, for example, a slight breeze, either natural or created artificially, such as by a fan. Flexible post portion 16 is configured to flex more or less depending upon the attributes of the ballast and novelty portions that are coupled to it. The novelty system of the present invention is configured to couple to, or be placed in a flowerpot and sail, or coupled to another type of base and to extend above the base much like an insect or bird would hover above an object or surface. Furthermore, small amounts of force, such as wind acting upon novelty system 10 will cause the extension members 22 and the novelty portion 12 to move about much like the fluttering of a butterfly or bird wings, or the movement of another type of extension member.

While the present invention has been described with regards to particular embodiments, it is recognized that additional variations of the present invention may be devised without departing from the inventive concept.

What is claimed is:

1. A novelty simulating system comprising:

a novelty portion;

a ballast portion;

a ballast support portion configured to couple to said ballast portion for supporting said ballast portion beneath said novelty portion offset therefrom; and a flexible post portion configured to couple to said novelty portion and said ballast portion.

2. The system of claim 1, further comprising a base configured to couple to said flexible post portion.

3. The system of claim 2, wherein said flexible post portion further comprises a second end adjacent to said base.

4. The system of claim 1, wherein said flexible post portion includes a first end adjacent to said novelty, ballast, and ballast-support portions.

5. The system of claim 4, wherein said first end of said flexible post portion further comprises a connection portion.

6. The system of claim 5, wherein said ballast-support portion is configured to couple to said connection portion of said post portion.

7. The system of claim 1, wherein said ballast portion comprises one or more ballast elements.

8. The system of claim 7, wherein said one or more ballast elements comprise a sphere.

9. The system of claim 1, wherein said ballast-support portion comprises a coiled wire.

10. A simulating novelty system comprising:

a novelty portion including a body member and an extension member;

a ballast portion disposed beneath said novelty portion offset therefrom; and a post portion coupled to said novelty and ballast portions having two ends;

wherein a first end of said post portion is adjacent to said novelty and ballast portions; and wherein a second end of said post portion is configured to couple to a base.

11. The system of claim 10, wherein said base comprises a flowerpot.

12. The system of claim 10, wherein said first end of said post portion includes one or more leg members configured to secure said post portion to said base.

13. The system of claim 10, wherein said second end of said post portion is configured to support said ballast portion.

14. The system of claim 10, wherein said body member is selectably rotatable with respect to said post portion.

15. The system of claim 10, wherein said extension members comprises a wing element and an attachment element.

16. The system of claim 15, wherein said attachment element is configured to couple to said body member and to one or more said extension members.

17. The system of claim 15, wherein said attachment element is configured to flex under application of relatively low forces.

18. The system of claim 10, wherein said ballast portion comprises one or more ballast elements.

19. The system of claim 18, wherein said one or more ballast elements comprise a geometric shape.

20. The system of claim 19, wherein said one or more ballast elements is a glass sphere.

21. A simulating novelty system comprising:

a novelty portion including a body member and an extension member;

a ballast portion; and a post portion having two ends, a first end of said post portion being adjacent to said novelty and ballast portions, a second end of said post portion being configured to couple to a base;

wherein said extension member comprises a wing element and an attachment element;

wherein said attachment element is a coil spring.

22. A novelty simulating system comprising:

a novelty portion;

a ballast portion suspended beneath said novelty portion offset therefrom; and a flexible post portion coupled to said novelty and ballast portions, such that said flexible post portion flexes.

* * * * *